US008540352B2

(12) United States Patent
Igarashi

(10) Patent No.: US 8,540,352 B2
(45) Date of Patent: Sep. 24, 2013

(54) INKJET RECORDING APPARATUS

(75) Inventor: Masanori Igarashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 279 days.

(21) Appl. No.: 12/873,778

(22) Filed: Sep. 1, 2010

(65) Prior Publication Data

US 2011/0057998 A1 Mar. 10, 2011

(30) Foreign Application Priority Data

Sep. 4, 2009 (JP) ..... 2009-204220

(51) Int. Cl.
*B41J 2/175* (2006.01)

(52) U.S. Cl.
USPC ..... 347/85; 347/84

(58) Field of Classification Search
USPC ..... 347/7, 17, 19, 84, 85
See application file for complete search history.

(56) References Cited

U.S. PATENT DOCUMENTS

| | | | | |
|---|---|---|---|---|
| 4,038,667 | A * | 7/1977 | Hou et al. | 347/35 |
| 4,658,272 | A * | 4/1987 | Toganoh et al. | 347/42 |
| 5,010,354 | A | 4/1991 | Cowger et al. | |
| 5,760,806 | A | 6/1998 | Oda et al. | |
| 6,027,205 | A * | 2/2000 | Herbert | 347/54 |
| 6,447,084 | B1 * | 9/2002 | Uetsuki et al. | 347/7 |
| 6,840,604 | B2 * | 1/2005 | Kimura et al. | 347/85 |
| 2005/0116999 | A1 | 6/2005 | Ando et al. | |
| 2007/0019045 | A1 | 1/2007 | Umeda | |
| 2007/0252860 | A1 | 11/2007 | Nitta et al. | |
| 2008/0246823 | A1 | 10/2008 | Comas et al. | |
| 2008/0273046 | A1 | 11/2008 | Ishinaga et al. | |
| 2009/0244131 | A1 | 10/2009 | Shibata | |
| 2010/0053283 | A1 | 3/2010 | Ito | |
| 2010/0079516 | A1 | 4/2010 | Nakazawa | |

FOREIGN PATENT DOCUMENTS

| | | |
|---|---|---|
| EP | 1464503 A2 | 10/2004 |
| JP | 2898746 | 3/1999 |
| JP | 3269268 | 1/2002 |
| JP | 2002-301826 | 10/2002 |
| JP | 2003-341028 | 12/2003 |
| JP | 2005-125667 | 5/2005 |
| JP | 2005-262521 | 9/2005 |
| JP | 2007-98594 | 4/2007 |
| JP | 2007-223230 | 9/2007 |

(Continued)

OTHER PUBLICATIONS

Jan. 21, 2011 European search report in connection with counterpart European patent application No. 10251541.

(Continued)

*Primary Examiner* — Anh T. N. Vo
(74) *Attorney, Agent, or Firm* — Cooper & Dunham LLP

(57) ABSTRACT

An inkjet recording apparatus is disclosed. The inkjet recording apparatus includes a droplet ejecting head which has multiple nozzles for ejecting ink, multiple head tanks which generate a negative pressure at the droplet ejecting head and temporarily store a predetermined amount of ink, an ink cartridge which stores the ink, multiple liquid sending pumps which perform a forward transfer liquid process which sends the ink from the ink cartridge to the multiple head tanks, or a backward transfer liquid process which sends the ink from the multiple head tanks to the ink cartridge, and an ink supply channel being branched from the ink cartridge to multiple head tanks to supply ink from the ink cartridge to multiple head tanks by the corresponding one of multiple liquid sending pumps.

18 Claims, 18 Drawing Sheets

(56) References Cited

FOREIGN PATENT DOCUMENTS

| | | |
|---|---|---|
| JP | 2007-245451 | 9/2007 |
| JP | 2008-213392 | 9/2008 |
| JP | 2009-126049 | 6/2009 |

OTHER PUBLICATIONS

Japanese official action dated Jun. 7, 2013 in corresponding Japanese patent application No. 2009-204220.

* cited by examiner

INKJET RECORDING APPARATUS

TECHNICAL FIELD

The present invention generally relates to inkjet recording apparatuses, and specifically relates to techniques for preventing a bubble from being generated at the time of replacing an ink cartridge and preventing negative pressure loss from occurring at the time of waiting after ink ejection.

BACKGROUND ART

An inkjet recording device provides energy by means of an energy providing unit such as a piezoelectric element that is provided at a liquid chamber in an ink head so as to eject ink in the liquid chamber from an ink nozzle as an ink droplet, and apply the ejected ink droplet onto recording paper to perform printing, which ink recording device is widely popular as it is cheap and compact. Below, a configuration of a related-art inkjet recording device is described with reference to the drawings.

FIG. 15 is a schematic configuration diagram illustrating a configuration of an ink supplying piping in the related-art inkjet recording device. As shown, the related-art ink supplying piping is configured to run from an ink cartridge 11 via a liquid sending pump 12 through a liquid sending tube 13 to a head tank 14, and a head is configured with single pipings of Bk, C, M, and Y. Then, when the ink within the head tank 14 is consumed for printing or maintenance, the ink is sent from the ink cartridge 11 by the liquid sending pump 12 through the liquid sending tube 13 into the head tank 14 to replenish the ink.

Now, there are three types of basic maintenance processes as follows:

1. Cleaning (Optional/Automatic): a light non-ejecting nozzle is recovered;
2. Refreshing (Optional): a non-ejecting nozzle not recovering with the cleaning is recovered; and
3. Atmospheric release filling (Automatic): if a negative pressure loss occurs, a negative pressure is generated.

While the above-described items 1 and 2 are nozzle recovery operations, so that a certain amount of ink needs to be discharged from the nozzle, as for the above-described item 3, from an objective of negative pressure generation (change in volume of the head tank), it is not necessary to discharge the ink from the nozzle.

FIG. 16 is a perspective view illustrating a structure of the head tank of the inkjet recording device. As shown, a negative pressure lever 14-1, which is provided inside the head tank, is a lever which operates following a film 14-2 which is displaced in accordance with an amount of consumption of ink contained within a head tank in which the negative pressure is occurring due to a spring (not shown) which biases the film 14-2. A supply port 14-3 is a supply port into which ink is supplied from below-described ink cartridges 110*k*-110*y* of FIGS. 1 and 3 via an ink supply tube 136 of FIG. 3. Moreover, an atmospheric release pin 14-4 is a pin which releases the inside of the head tank to the atmospheric state, as needed. Furthermore, below the head tank is provided a recording head 14-5 which injects an ink droplet. Moreover, a sensing mechanism 14-6 which senses the ink or air is provided.

Then, as shown in FIG. 17, for generating the negative pressure within the head tank, the ink is discharged from a head nozzle 15 by an absorption cap 21 which covers the head nozzle 15 to change the volume within the head tank 14 to deform a spring inside the head tank. The ink discharged from the head nozzle 15 by the absorption cap 21 is stored as waste liquid at a waste liquid tank 23 by an absorption pump 22.

On the other hand, in these inkjet recording devices, it is becoming predominant to use an ink cartridge as a unit for supplying ink. There is a problem that a non-ejecting of the ink is caused by air mixing in when the ink cartridge is replaced. There have been a number of related-art proposals made in order to overcome this problem. As one of the proposals, Patent document 1 discloses a liquid ejecting device which is provided with an ink supply conduit which supplies ink from an ink tank to an ink head, and an ink flux conduit which refluxes the ink from the ink head to the ink tank to circulate the ink between the ink head and the ink tank to prevent the ink from leaking from a nozzle. For ink-supplying piping components in the related art inkjet recording devices including what is disclosed in Patent document 1, an ink cartridge, a liquid sending pump, a liquid sending tube, a head tank, and an ink head use a lot of resin material for an ink flow channel section. Moreover, for a joint between parts, a rubber packing, etc. is used to ensure sealing performance. At the body waiting time, inside the head tank is in a state of negative pressure. There is no problem as long as the body waiting time is a waiting time at a level expected in normal use.

Moreover, in an inkjet recording device with the ink cartridge having a large ink capacity, the ink cartridge being directly mounted to a recording head which is mounted to a carriage and ink being supplied to the recording head could cause trouble with carriage operations due to the weight of the ink cartridge, thus decreasing the image quality. Then, there is an inkjet recording device which has provided therewith the ink cartridge on the body side and which has a recording head within a carriage, provided with a head tank 14, as shown in FIG. 14, which temporarily stores the ink to be used in printing. In such an inkjet recording device as described above, when trying to send the ink with the ink cartridge on the body side being empty, the negative pressure within a liquid sending channel from the cartridge on the body side to the head tank becomes strong, so that an air bubble gets into the ink sending channel by tucking in and taking out the ink cartridge. When the air bubble gets into the liquid sending flow channel, it gets into a subtank via the liquid sending channel. Then, if ink is supplied with an atmospheric release valve being open, for example, a mixture of the air bubble and the ink could leak from the atmospheric release valve. The mixture leaking from the atmospheric release valve leads to a failure such as a head damage. Moreover, the air bubble which found its way into the mixture penetrating into the nozzle in the recording head leads to an image degradation defect such as a nozzle clog, etc.

Then, in order to solve the above-described problems, a number of proposals have been made to date. As one of the proposals, Patent document 2 discloses an inkjet printer which is provided with an intermediate ink tank between an ink cartridge and a recording head, and with a pressure sensor remote from the intermediate ink tank to sense a negative pressure state within the recording head, and move the intermediate ink tank upward and downward as needed to maintain a desired negative pressure. Moreover, Patent document 3 discloses a proposed ink supply device in which, when a pressure of a main tank chamber decreases as ink is consumed, the ink for an amount corresponding to the decreased pressure is automatically supplied from a sub tank chamber having meniscus constituting members that accompanies the main tank chamber for storing the ink so as to maintain a desired negative pressure. Furthermore, Patent document 4 discloses a proposed inkjet pen in which the ink is filled into a sealed up ink tank, one end of which is provided with a small hole being released to the atmosphere, and, when the ink within the ink tank is consumed, air is supplied via the small hole into the ink tank, which inside is maintained at a desired negative pressure.

PATENT DOCUMENTS

Patent document 1: JP2005-125667A
Patent document 2: JP2003-341028A
Patent document 3: JP3269268B
Patent document 4: JP2898746B However, according to Patent document 1, a (an atmospheric pressure) phenomenon occurs such that the negative pressure within the head tank is completely lost when a predetermined waiting time is reached. Reasons for the occurrence of the phenomenon include sealing performance of packing, infiltration performance of rubber material and resin material. Moreover, inside the supply piping being in the negative pressure state (a negative pressure producing source, the head tank) causes air to be taken into the piping, resulting in the loss of the negative pressure of the head tank. More specifically, with respect to maintaining the negative pressure of the head tank, at the present, when it is left for a long time and the negative pressure is lost, as described above, a large volume of ink is discharged to the outside from the head nozzle to an absorption cap to generate the negative pressure. The discharged ink is stored in a waste liquid tank and is not reusable. In other words, a consumption of the ink not only for printing but also for a case such that the negative pressure loss occurs at the head tank is a wasteful consumption of the ink. As described previously, the causes for the occurrence of the negative pressure loss due to leaving the head tank for a long time are the sealing performance of packing, the infiltration performance of the rubber material and the resin material. Countermeasures for these causes may include, for the infiltration performance of the resin material and the rubber material, changing to a high performance resin or rubber material, changing to a metal material, providing metal coating on a part surface and, for the sealing performance of packing, bonding by adhering, and bonding by welding, and integrating parts (decreasing connecting sections). However, in practice, from viewpoints of technical degree of difficulty, cost, and layout constraints, etc., the possibility of implementation is low.

Moreover, in Patent document 2, the system may be become complicated and enormous as each of the recording head, the intermediate ink tank, and the pressure sensor are arranged to be apart from one another. Furthermore, providing with a mechanism for making upward and downward movements in a negative pressure maintaining mechanism by moving the intermediate ink tank upward and downward is also a cause for the system to become complicated and enormous. Moreover, when the air bubble gets into the intermediate ink tank for some reason at the time of replacing the ink cartridge, it is difficult to properly remove the air bubble. Furthermore, in Patent document 3, when it becomes difficult to maintain a desired negative pressure due to degradation in the meniscus constituting member, or if the air bubble gets into the sub-tank chamber for some reason at the time of replacing the ink cartridge, it is difficult to properly remove the air bubble. Moreover, in Patent document 4, it is always released to atmosphere, so that the air bubble may get into the head flow channel, removing of which air bubble being difficult.

DISCLOSURE OF THE INVENTION

An object of the present invention is to solve the problems as described above by providing an inkjet recording apparatus which makes it possible to prevent an air bubble from getting into a liquid sending channel when the ink cartridge is replaced, and to prevent failures such as a damage of a recording head, a nozzle clog, etc, while preventing a negative pressure loss and allowing a stable ink ejection while maintaining the supplying piping components as they exist in a simple configuration.

In order to overcome the problems as described above, an inkjet recording apparatus is provided, including a droplet ejecting head which has multiple nozzles for ejecting ink, multiple head tanks which generate a negative pressure at the droplet ejecting head and temporarily store a predetermined amount of ink, an ink cartridge which stores the ink, multiple liquid sending pumps which perform a forward transfer liquid process which sends the ink from the ink cartridge to the multiple head tanks, or a backward transfer liquid process which sends the ink from the multiple head tanks to the ink cartridge, and an ink supply channel being branched from the ink cartridge to multiple head tanks to supply ink from the ink cartridge to multiple head tanks by the corresponding one of multiple liquid sending pumps, wherein, at least one of the multiple liquid sending pumps performing the forward transfer liquid process when there is a short supply of ink in the ink cartridge without being able to send the ink from the ink cartridge to one of the head tanks, and then each of the multiple liquid sending pumps performing the backward transfer liquid process for a predetermined ink amount.

The inkjet recording apparatus according to the present invention makes it possible to prevent an air bubble from getting into a liquid sending channel when the ink cartridge is replaced, and to prevent failures such as a damage of a recording head, a nozzle clog, etc, while preventing a negative pressure loss and allowing a stable ink ejection while maintaining the supplying piping components as they exist in a simple configuration.

BEST MODE FOR CARRYING OUT THE INVENTION

Descriptions are given next, with reference to the accompanying drawings, of embodiments of the present invention.

The present invention is not limited to the specifically disclosed embodiments, but variations and modifications may be made without departing from the scope of the present invention.

Figure 1:
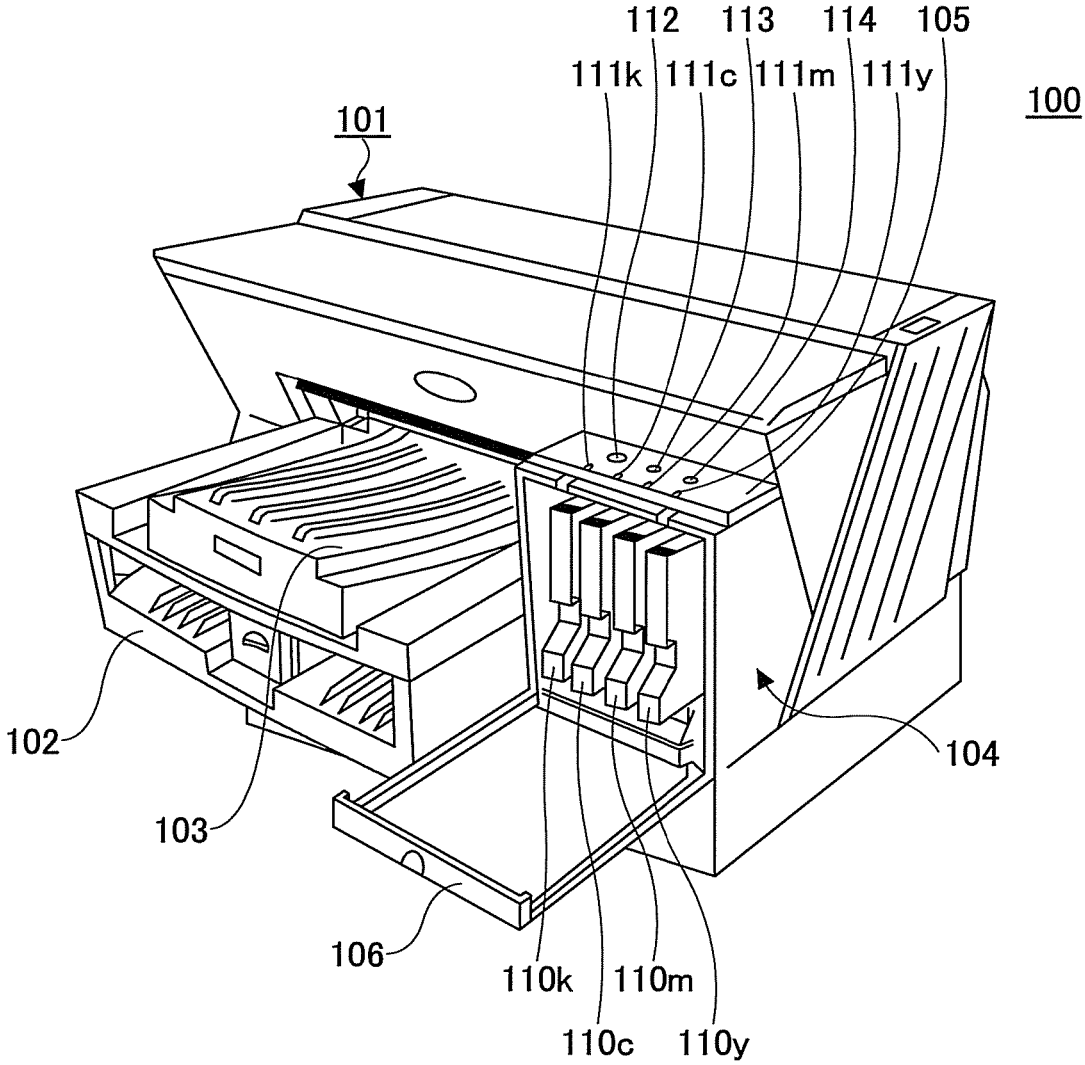
FIG. 1 is a frontal perspective view of an inkjet recording device according to the present invention.

FIG. 1 is a frontal perspective view of an inkjet recording device according to the present invention. The inkjet recording device 100 shown according to the present invention includes a device body 101; a paper-supply tray 102 for loading a sheet mounted to the device body 101; and a paper-output tray 103 removably mounted to the device body 103 for stocking the sheet on which an image is recorded (formed). Moreover, on the side of one end of the front face of the device body 101 (the side of the paper-supply and paper-output trays) is provided a cartridge loading section 104 for loading ink cartridges that are located lower than the upper face, on which upper face is provided an operation/display section 105 such as an operation button and display.

This cartridge loading section 104 allows for inserting, from the front face side to the back side of the device body 101, ink cartridges 110*k*, 110*c*, 110*m*, and 110*y* (called "ink cartridge 110" when not distinguishing between colors), which are recording liquid cartridges as multiple recording liquid containing units, each of which contains a recording liquid (ink) (for example, black (K) ink, a cyan (C) ink, a magenta (M) ink, a yellow (Y) ink) as a color material of a different color, and on the front face side of the cartridge loading section 104 is provided a front cover (cartridge cover) 106 which opens when the ink cartridge 110 is to be pulled out and tucked in such that the front cover 106 can open and close. Moreover, the ink cartridges 110*k*, 110*c*, 110*m*, and 110*y* are arranged to be loaded such that they line up in a lateral direction, each of which ink cartridges standing vertically.

Furthermore, the operation/display section 105 has arranged thereon a residual toner amount display section for each color 111*k*, 111*c*, 111*m*, 111*y* that is for displaying that a residual amount of the ink cartridges of each color 110*k*, 110*c*, 110*m*, and 110*y* has reached the near-end or the end at an arranged location corresponding to a mounting location (arranging location) of the ink cartridges of each color 110*k*, 110*c*, 110*m*, and 110*y*. Moreover, the operation/display section 105 is also provided with a power button 112, sheet sending/print resuming button 113, and cancel button 114.

Figure 2:
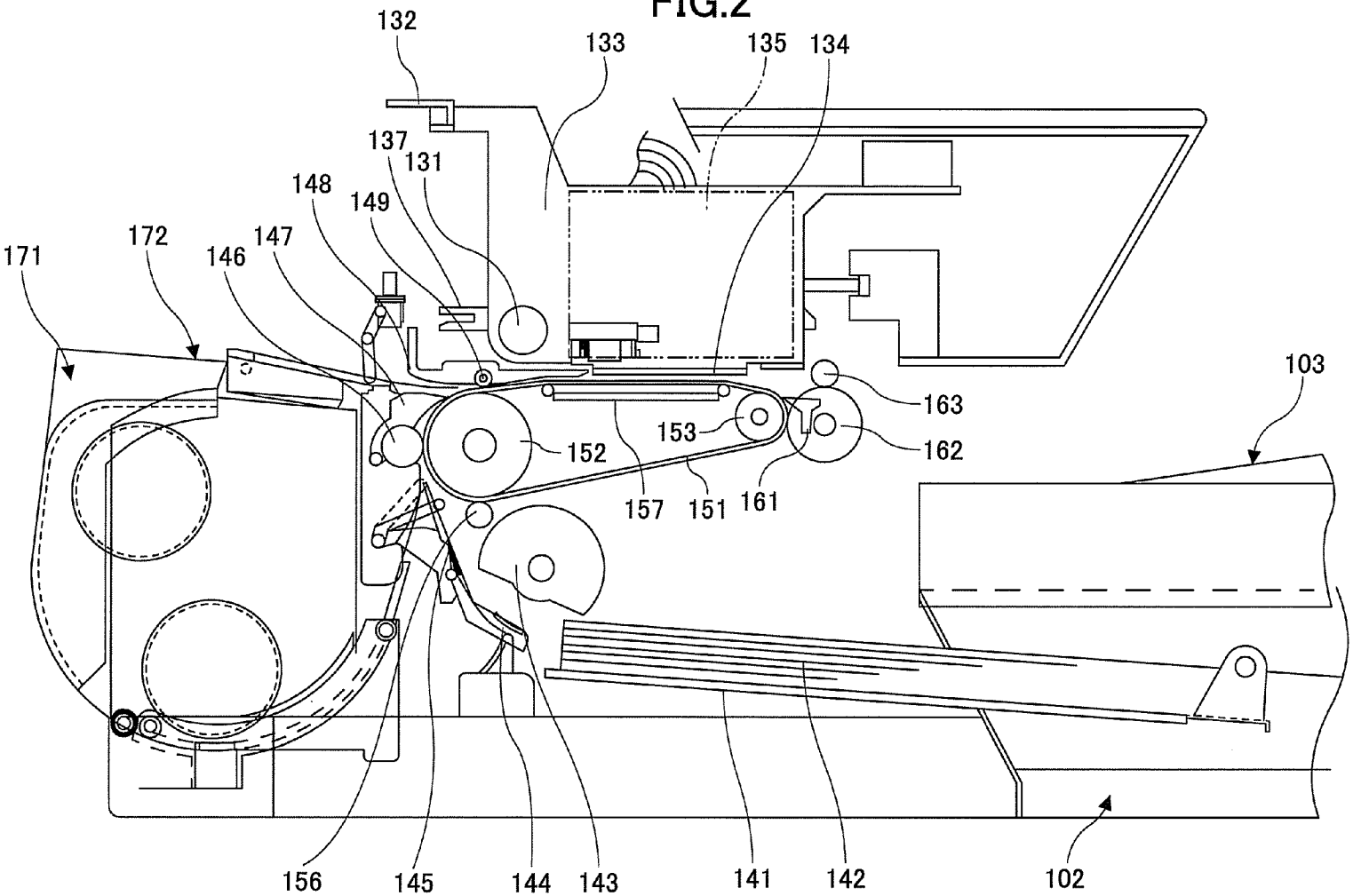
FIG. 2 is a lateral view illustrating an overview of a machinery section of the inkjet recording device according to the present invention.

Next, a machinery section of the inkjet recording device is described with reference to FIGS. 2 and 3. FIG. 2 is a lateral view illustrating an overview of the machinery section, while FIG. 3 is a feature plane view of the same.

Figure 3:
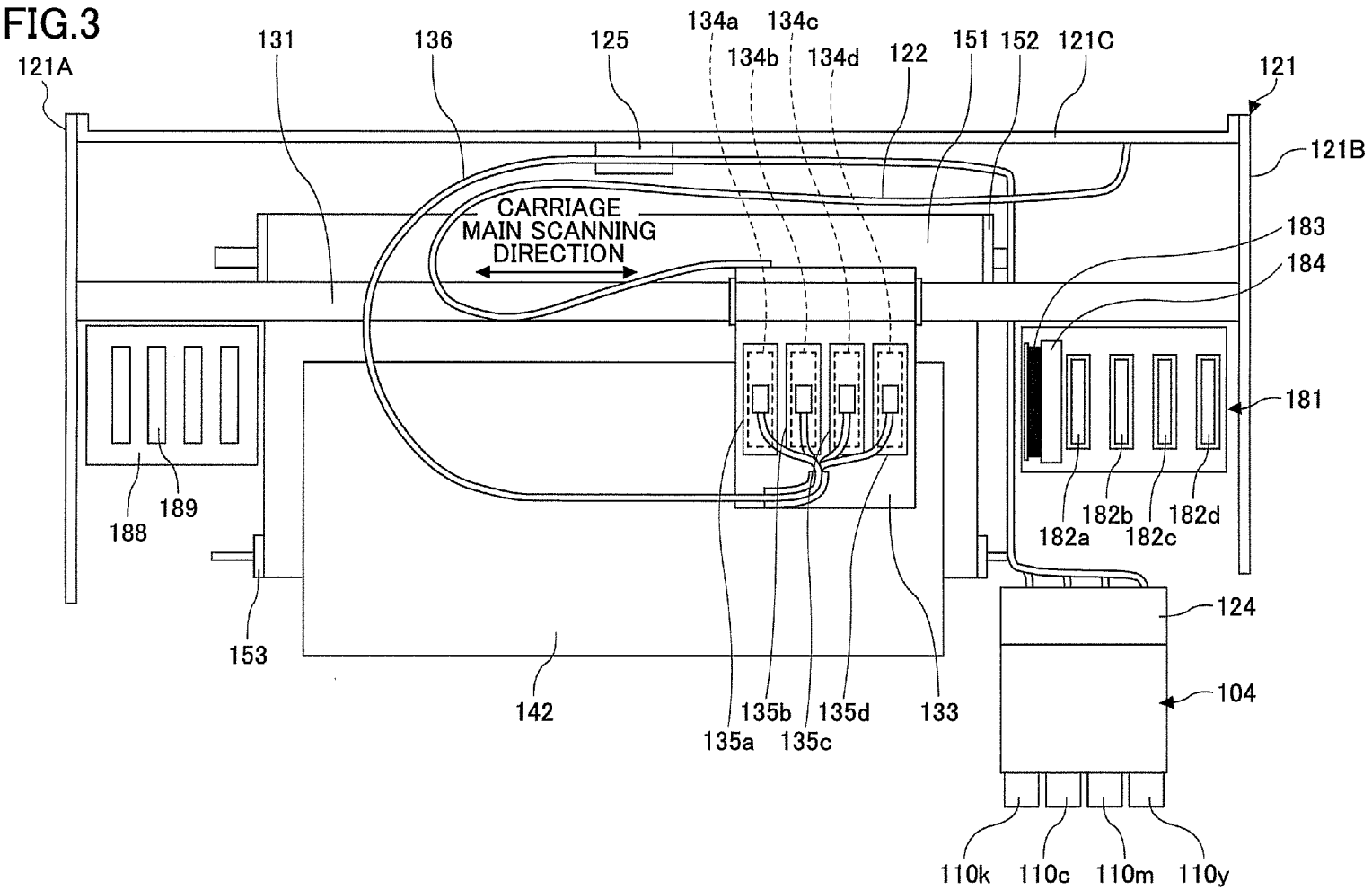
FIG. 3 is a feature plane view illustrating the overview of the machinery section of the inkjet recording device according to the present invention.

In the machinery section of the inkjet recording device, a carriage 133 is held to be able to slide in a main scanning direction with a guiding rod 131 and a stay 132 which are guide members built across left and right side plates 121A and 121B which make up a frame 121, and, with a main scanning motor (not shown), moves and scans in a bi-directional carriage main scanning direction, which is a direction shown with an arrow in FIG. 3, via a timing belt.

Figure 4A:
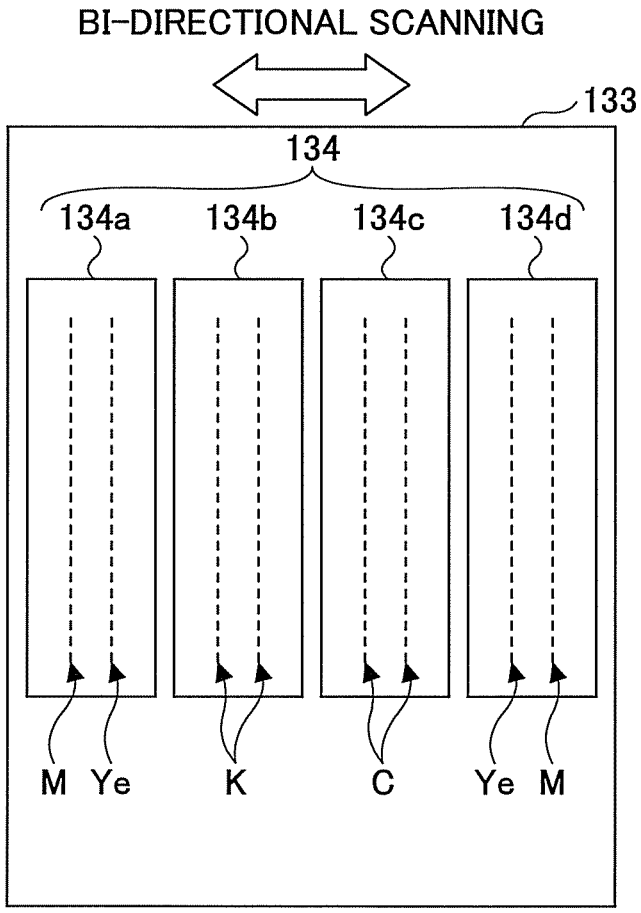
FIGS. 4A and 4B are diagrams illustrating a configuration of a droplet ejection head and a head tank which are mounted to a carriage in the inkjet recording device according to the present invention.
Figure 4B:
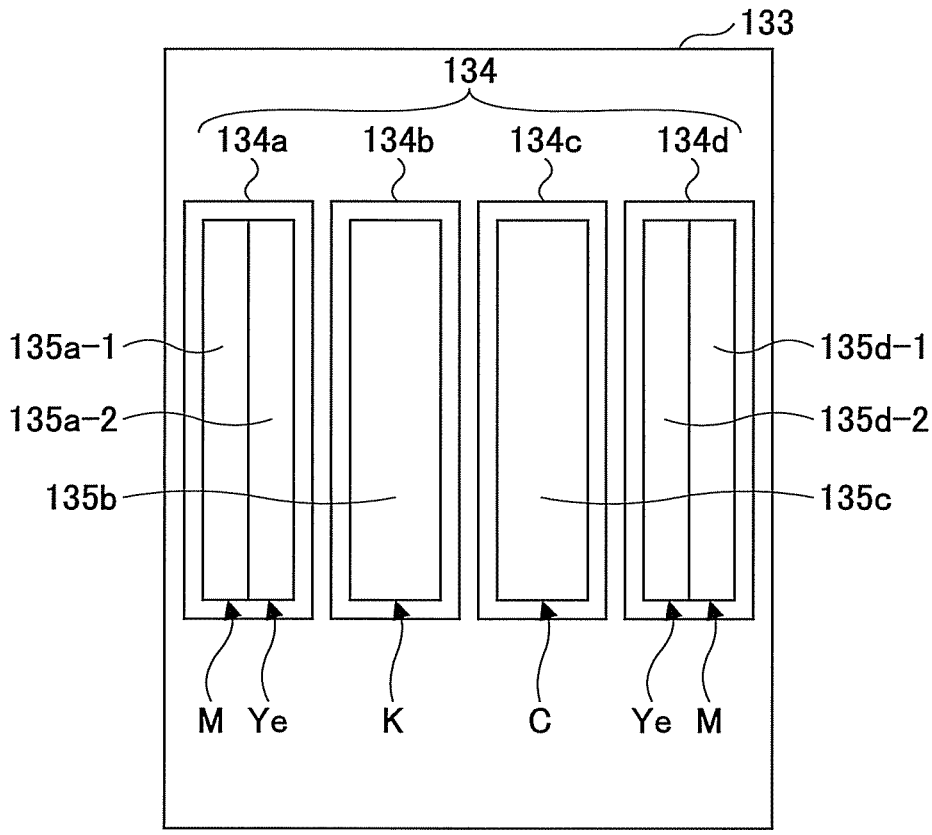

FIGS. 4A and 4B are diagrams illustrating a configuration of a droplet ejection head and a head tank which are mounted to a carriage in the inkjet recording device according to the present invention. As shown, this carriage 133 has mounted thereto liquid droplet ejection heads 134 with the ink droplet ejecting direction facing downwards, which liquid droplet ejection heads are arranged in a direction which crosses the main scanning direction and which includes a liquid droplet ejection head 134*a* which ejects ink droplets of magenta (M) and yellow (Y), a liquid droplet ejection head 134*b* which ejects an ink droplet of black (K), a liquid droplet ejection head 134*c* which ejects an ink droplet of cyan (C), and a liquid droplet ejection head 134*d* which ejects ink droplets of yellow (Y) and magenta (M). Moreover, as shown in FIG. 4A, each liquid droplet ejection head has respectively two nozzle sequences. One nozzle sequence of the liquid ejection head 134*a* ejects the liquid droplet of magenta (M), while the other nozzle sequence ejects the liquid droplet of yellow (Ye). Moreover, two nozzle sequences of the liquid ejection head 134*b* both eject the liquid droplet of black (M). Moreover, two nozzle sequences of the liquid ejection head 134*c* both eject the liquid droplet of cyan (C). Furthermore, one nozzle sequence of the liquid ejection head 134*d* ejects the liquid droplet of yellow (Ye), while the other nozzle sequence ejects the liquid droplet of magenta (M).

Here, as an inkjet head which makes up the liquid ejection head 134, what provides, as a pressure generating unit which generates a pressure for ejecting liquid droplets, a piezoelectric actuator such as a piezoelectric element, a thermal actuator which utilizes phase change by liquid film boiling using a thermoelectric conversion element such as a heat element, a shape-memory alloy actuator which uses a metal phase change by a temperature change, and an electrostatic actuator which uses electrostatic force may be used.

As shown in FIG. 3, the droplet ejection head 134 has mounted thereto a driver IC and is connected with a controller (not shown) via a harness (flexible printed cable) 122. Moreover, as shown in FIG. 4B, the carriage 133 has mounted thereto a head tank 135 of each color for supplying ink of each color to the liquid droplet ejection head 134. A head tank of each color 135*a* has two head tanks such that a magenta (M) ink is supplied to one head tank 135*a*-1 and a yellow (Ye) ink is supplied to the other head tank 135*a*-2. Moreover, the head tank 135*b* includes one head tank such that a black (K) ink is supplied thereto. Furthermore, the head tank 135*c* includes one head tank such that a cyan (C) ink is supplied thereto. Moreover, the head tank 135*d* has two head tanks such that a yellow (Ye) ink is supplied to one head tank 135*d*-1 and a magenta (M) ink is supplied to the other head tank 135*d*-2. Then, ink of each color is replenished, via an ink supply tube 136 per color to the head tank of each color 135 from an ink cartridge of each color 110*y*, 110*m*, 110*c*, and 110*k* that is mounted to the cartridge loading section 104. The cartridge loading section 104 is provided with a supply pump unit 124 for sending ink within the ink cartridge 110, and the ink supply tube 136, in its way to coiling around, is held with a locking member 125 to a back plate 121C which makes up a frame 121.

Figure 5:
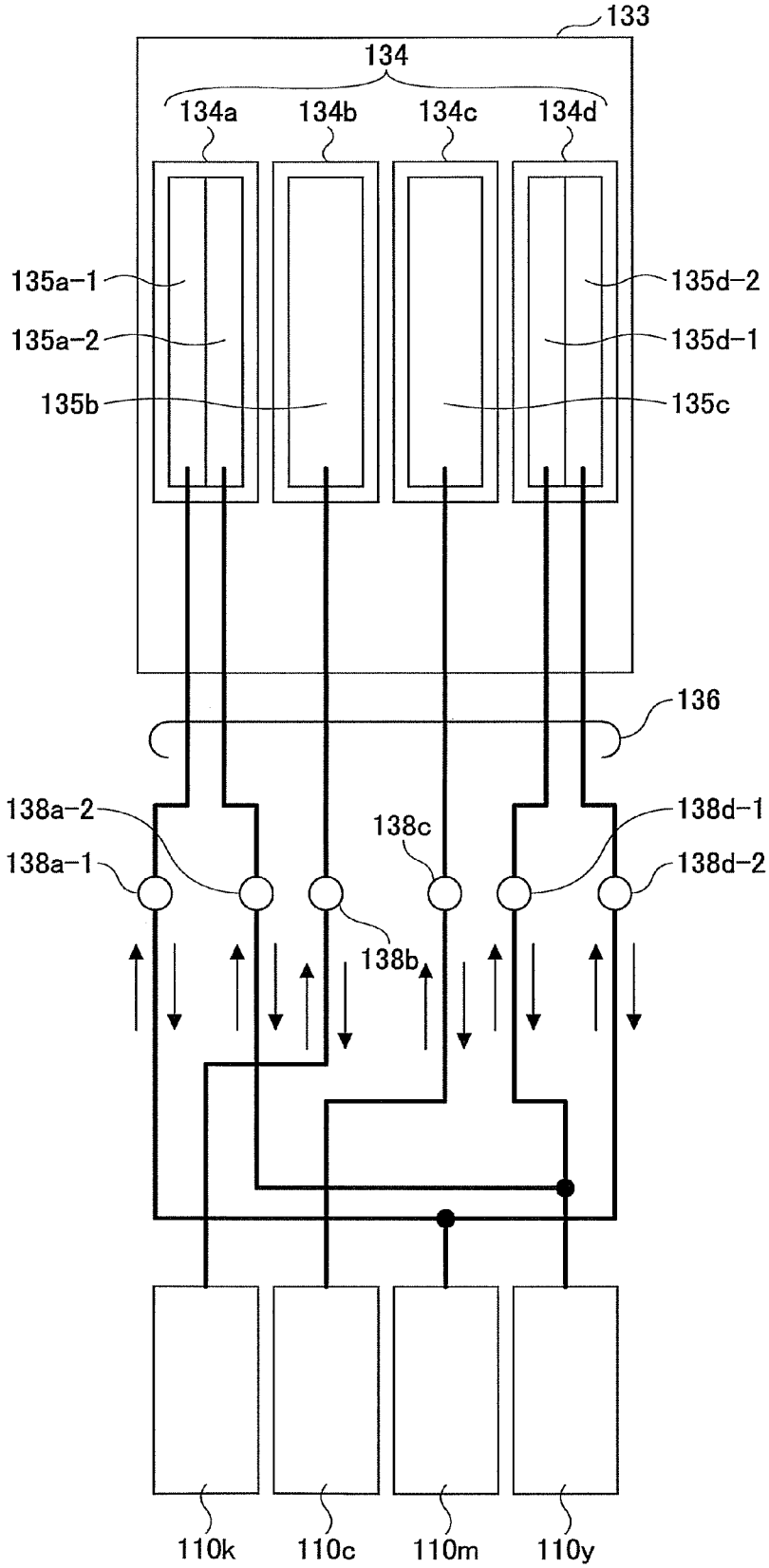
FIG. 5 is a schematic diagram illustrating a liquid sending configuration of the head tank and an ink cartridge in the inkjet recording device according to the present invention.

FIG. 5 is a schematic diagram illustrating a liquid sending configuration of a head tank and an ink cartridge in the inkjet recording device according to the present invention. As shown, a magenta (M) ink is supplied to a head tank 135*a*-1 via one ink supply tube 136 which branches from an ink cartridge 110*m* via a liquid sending pump 138*a*-1, and a yellow (Ye) ink is supplied to a head tank 135*a*-2 via the other ink supply tube 136 which branches from an ink cartridge 110*y* via a liquid sending pump 138*a*-2. Moreover, a black (K) ink is supplied to the head tank 135*b* from the ink cartridge 110*k* via the liquid sending pump 138*b*. Furthermore, a cyan (C) ink is supplied to the head tank 135*c* from the ink cartridge 110*c* via the liquid sending pump 138*c*. Moreover, a yellow (Ye) ink is supplied to a head tank 135*d*-1 via the other ink supply tube 136 which branches from an ink cartridge 110*y* via a liquid sending pump 138*d*-1, and a magenta (M) ink is supplied to a head tank 135*d*-2 via the other ink supply tube 136 which branches from an ink cartridge 110*m* via a liquid sending pump 138*d*-2.

On the other hand, as a paper-supply section for supplying sheets 142 loaded on a sheet loading section 141 (a pressure plate) for a paper-supply tray 102 in FIG. 2 is provided a crescent roller (a paper-supply roller) 143 which feeds, on a sheet by sheet basis, the sheets 142 from the sheet loading section 141 and a separation pad 144 which opposes the paper-supply roller 143 and which is made of a material of a large coefficient of friction, which separation pad 144 is biased to the paper-supply roller 143 side.

Then, in order to feed, into the lower side of the liquid droplet ejection head 134, the sheets 142 supplied from the paper-supply section, a guide member 145 which guides the sheets 142, a counter roller 146, a conveying guide member 147, and a pressing member 148 which has a tip pressure roller 149, as well as a conveying belt 151 which is a conveying unit for electrostatically adsorbing the sheets 142 supplied to convey the electrostatically adsorbed sheets 142 at a location opposing the liquid droplet ejection head 134.

This conveying belt 151, which is an endless belt, is arranged to be built between a conveying roller 152 and a tension roller 153 to revolve in the belt-conveying direction (sub-scanning direction). Moreover, a charging roller 156 is provided which is a charging unit for charging the surface of the conveying belt 151. This charging roller 156, which is in contact with a surface of the conveying belt 151, is arranged such that it rotates following a rotational movement of the conveying belt 151. Then, a guide member 157 is arranged on the back side of the conveying belt 151 in correspondence with an area of printing by the droplet ejection head 134.

This conveying belt 151 circularly moves in the belt conveying direction in FIG. 3 by the conveying roller 152 being rotationally driven via a timing unit by a sub-scanning motor (not shown).

Moreover, as a paper-output section for outputting sheets 142 recorded with the liquid droplet ejection head 134, a separating claw 161 for separating the sheets 142 from the conveying belt 151, and a paper-output roller 162 and a paper-output roller 163 are provided, and a paper-output tray 103 is provided below the paper-output roller 162.

Furthermore, a double face unit 171 is removably mounted to a back face section of the device body 101. This double face unit 171 takes in sheets 142 returned in a reverse direction rotation of the conveying belt 151 to reverse the sheets so as to supply the sheets again between the counter roller 146 and the conveying belt 151. Moreover, the upper face of this double face unit 171 is arranged to be a manual bypass tray 172.

Furthermore, as shown in FIG. 3, a maintenance and recovery mechanism 181, which includes a recovery unit for maintaining and recovering a state of a nozzle of the liquid droplet ejection head 134, is arranged at a non-print area on one side of a scanning direction of the carriage 133.

This maintenance and recovery mechanism 181 is provided with each capping member (below called "cap") 182*a*-182*d* (called "cap 182" when not distinguishing therebetween) for capping each nozzle face of the liquid droplet ejection head 134, a wiper blade 183, which is a blade member for wiping the nozzle face, and a non-contributing ejection receiver 184 for receiving a liquid droplet ejected which does not contribute to recording in order to eject recording liquid of increased viscosity. Here, the cap 182*a* is arranged to be a cap for absorption and moisture retention, while the caps 182*b*-182*d* are arranged to be caps for moisture retention.

Then, waste liquid of the recording liquid that is produced in the maintenance and recovery operation with the maintenance and recovery mechanism 181, ink discharged to the cap 182, or ink adhered to the wiper blade 183 that is removed with the wiper cleaner 185, and non-contributing ink which is ejected into the non-contributing ejection receiver 194 are discharged to a waste liquid tank (not shown) to be contained therein.

Moreover, as shown in FIG. 3, in a non-printing area of the other side of the scanning direction of the carriage 133, a non-contributing discharge receiver 188 is arranged which receives a droplet ejected which does not contribute to recording in order to discharge recording liquid with viscosity increased during recording, etc., which non-contributing ejection receiver 188 being provided with an opening section 189 along a nozzle sequence direction of the liquid droplet ejection head 134.

In the inkjet recording device of the present invention that is arranged as described above, sheets 142 are supplied from a paper-supply tray 102 on a sheet by sheet basis, the sheets 142 supplied substantially vertically upward are guided by the guide 145, placed between the conveying belt 151 and the counter roller 146 to be conveyed, has a tip thereof guided with the conveying guide 137 to be pressed against the conveying belt 151 with a tip pressurizing roller 149, and has the conveying direction turned substantially 90 degrees.

Then, an alternate repetition of a positive output and a negative output, or in other words, an alternate voltage is applied to the charging roller 156 from the below-described AC bias supply unit of the below-described controller, so that the conveying belt 151 is charged in alternating voltage charge patterns, or, in other words, alternately charged positive and negative in a shape of bands in a predetermined width in a sub-scanning direction, which is a circularly rotating direction. The sheets 142, when fed onto the conveying belt 151 alternately charged positive and negative, are adsorbed to the conveying belt 152, and conveyed in the sub-scanning direction by a circular rotational movement of the conveying belt 151.

Then, the liquid droplet ejection head 134 is driven according to an image signal while moving the carriage 133 in a main scanning direction based on main scanning position information with a linear encoder 137 to eject an ink droplet onto sheets 142 at rest to record what amounts to one line, and recording for the following line is performed after the sheets 142 are conveyed for a predetermined amount. When a recording termination signal or a signal that a trailing end of the sheet 142 has reached the recording area is received, the recording operation is terminated, so that the sheets 142 are output to the paper-output tray 103.

Moreover, while waiting for printing (recording), the carriage 133 is moved to the maintenance and recovery mechanism 181 side and the liquid droplet ejection head 134 is capped with the cap 182 to maintain the nozzle in a wet state, thus preventing ejection failure due to ink drying. Furthermore, recording liquid is absorbed from the nozzle ("called "nozzle absorption" or "head absorption") with an absorbing pump (not shown) with the liquid droplet ejection head 134 being capped with the cap 182, and recovery operation is performed which discharges air bubble and recording liquid with increased viscosity. Moreover, before starting recording, a non-contributing ejection operation is performed, in the middle of recording, which ejects ink not related to the recording. In this way, a stable ejection performance of the liquid droplet ejection head 134 is maintained.

Figure 6:
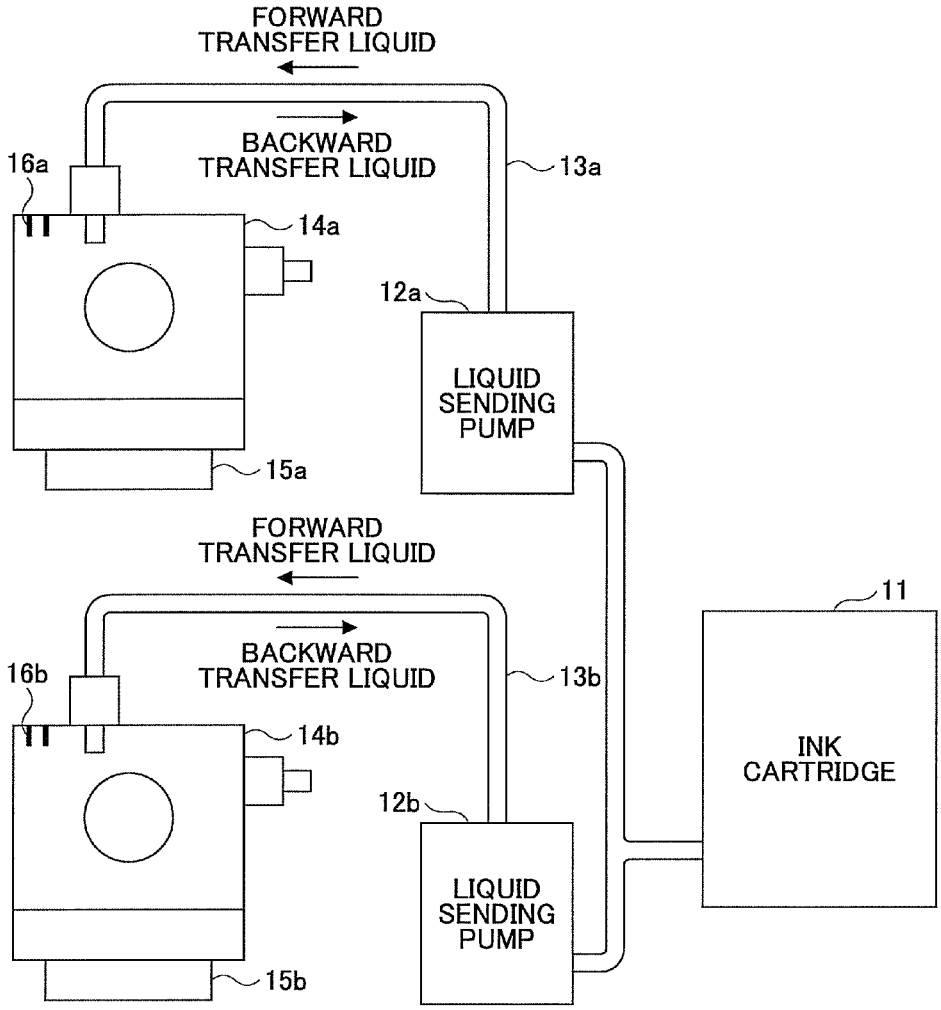
FIG. 6 is a schematic configuration diagram of a configuration of an ink supply piping in the inkjet recording device according to one embodiment of the present invention.
Figure 15:
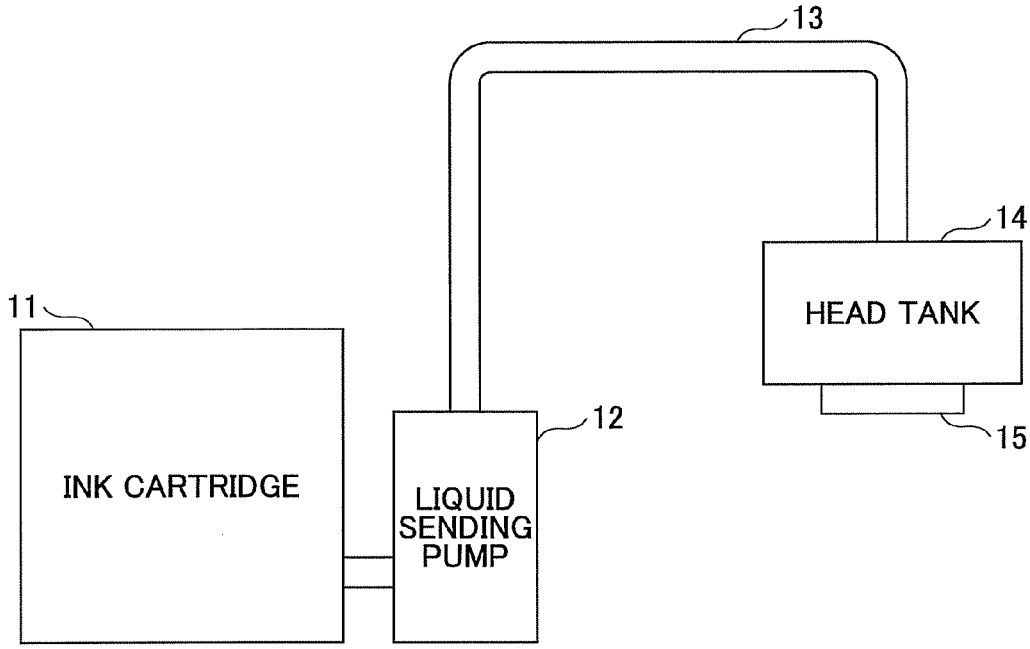
FIG. 15 is a schematic configuration diagram illustrating a configuration of an ink supplying pipe in the related-art inkjet recording device.
Figure 16:
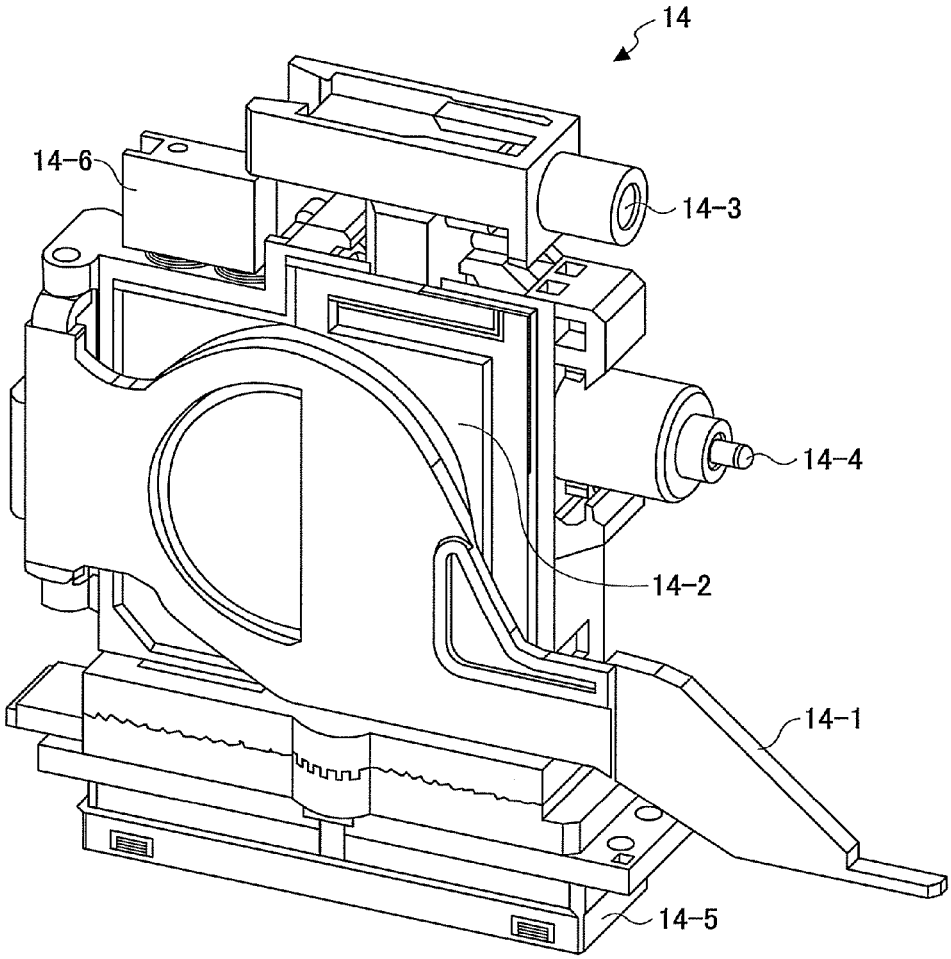
FIG. 16 is a perspective view illustrating a structure of the head tank of the inkjet recording device.
Figure 17:
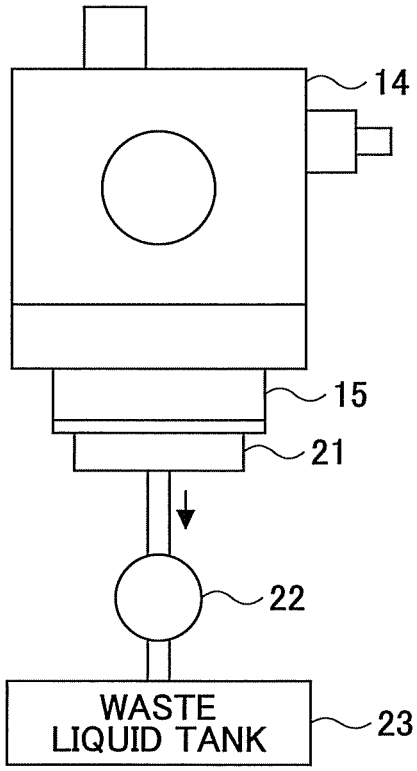
FIG. 17 is a schematic cross-sectional diagram illustrating how a negative pressure is generated within the head tank.

FIG. 6 is a schematic configuration diagram of a configuration of an ink supply piping in the inkjet recording device according to one embodiment of the present invention. Therein, the same reference letter as in FIG. 15 represents the same elements. As shown, an ink supply piping in the inkjet recording device according to the present embodiment is piped, using each liquid sending tube 13*a* and 13*b*, to each of multiple (two as shown) head tanks 14*a* and 14*b* via each of multiple (two as shown) liquid sending pump 12*a* and 12*b* branching from one ink cartridge 11. The configuration of the ink supply piping as described above has a (backward flow) function which returns, to the ink cartridge 11 with each liquid sending pump 12*a*, 12*b*, ink within the head tank 14*a* and 14*b* rather than discharging ink within the head tank 14*a* and 14*b* from the nozzle face to collect the discharged ink in the waste liquid tank. This function makes it possible to overcome the negative pressure state between the ink cartridge and liquid sending pump and to prevent an air bubble from being generated when the ink cartridge 11 is taken out with the state between the ink cartridge and the liquid sending pump being of the negative pressure.

Figure 7:
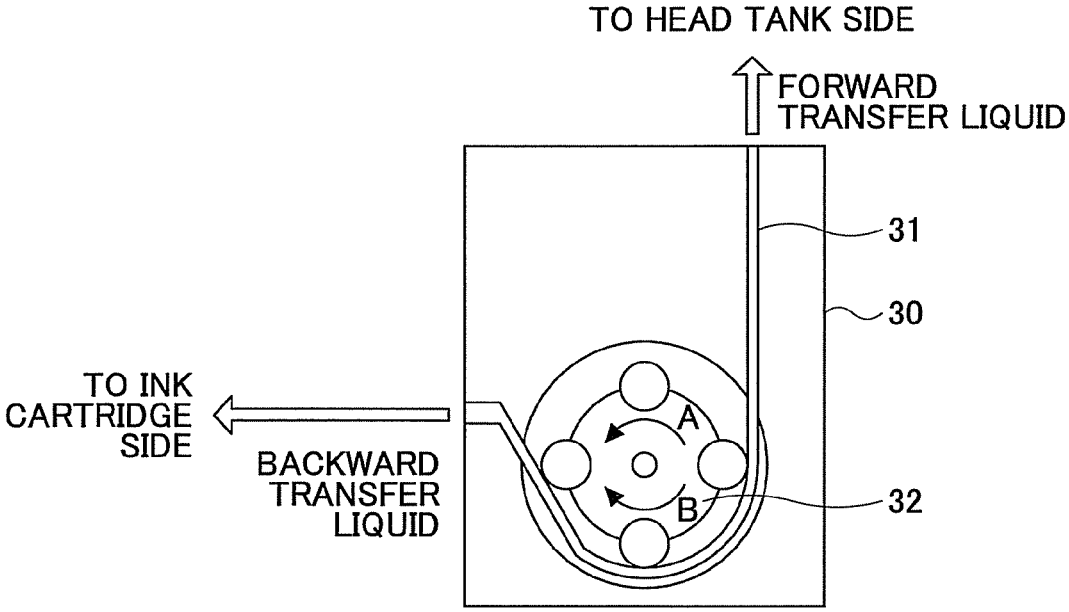
FIG. 7 is a schematic plane view illustrating a configuration of a tube pump as one example of a liquid sending pump.

Here, for the liquid sending pump 12 used in the present invention, a tube pump 30 as shown in FIG. 7 is adopted, which does not have a complicated pump structure and in which the forward and backward transfer of ink is possible by changing a rotating direction of a driving motor. Inside the pump of the tube pump 30, a rubber tube 31 for sending liquid coils around, and the rubber tube 31 is locally squeezed by a pump rotor 32 built inside the pump, and points squeezed are moved in the rotating direction by rotating the pump rotor 32, so that ink is sent in the rotating direction of the pump rotor 32. More specifically, when the ink is transferred in the forward direction from the ink cartridge to the ink tank, the pump rotor 32 is rotated in the rotating direction as shown with an arrow A. Conversely, when the ink is sent in the backward direction from the ink tank to the ink cartridge, the pump rotor 32 is rotated in the rotating direction as shown with an arrow B. Here, for the rotations of the pump rotor 32, the rotation in the rotating direction of the arrow A is called a forward rotation, while the rotation in the rotating direction of the arrow B is called a backward rotation. Thus, the rotations of the pump rotor 32 may be controlled for the forward and reverse directions to control a direction of sending ink. Moreover, a simply configured tube pump may be used for the liquid sending pump to provide a pump configuration in a small space. Furthermore, controlling the direction of sending liquid is possible by the forward and reverse control of the pump driving motor, allowing a simple piping. The tube pump may be structured to be of a type other than a rotating roller type as shown in FIG. 7, such as of an eccentric cam type.

Then, as in the present invention, with a head tank being provided for temporally storing recording liquid (such as ink) supplied from an ink cartridge, if the recording liquid (such as the ink) is unnecessarily sent to the head tank when the ink cartridge is empty, a joint section between the ink cartridge and the liquid sending pump is brought to a state of a large negative pressure. In this state, when the ink cartridge is inserted and removed at the time of replacing the ink cartridge, etc., an air bubble gets into a supply channel of a liquid sending pump, and the following supply operation causes the air bubble to be sent into the head tank. With the head tank being provided with an atmospheric release mechanism such as an atmospheric release valve, for example, when an excessive amount of air bubble gets into the head tank, not only the air bubble but also recording liquid (such as ink) leaks from the mechanism, causing a damage of a recording head, etc., and causing the air bubble to find its way into the head tank, leading to a nozzle clog due to the air bubble getting into a liquid chamber of the recording head, or a failure such as a negative pressure control abnormality.

Then, a control process such as liquid sending control flow at the time of replacing an ink cartridge as shown in FIGS. 8, 9, and 12-14 can be performed to prevent the air bubble from getting into an ink sending channel at the time of replacing the ink cartridge, making it possible to prevent a fault such as a damaged recording head. Below, liquid sending control at the time of replacing the ink cartridge is outlined in accordance with FIGS. 8, 9, and 12-14.

Figure 8:
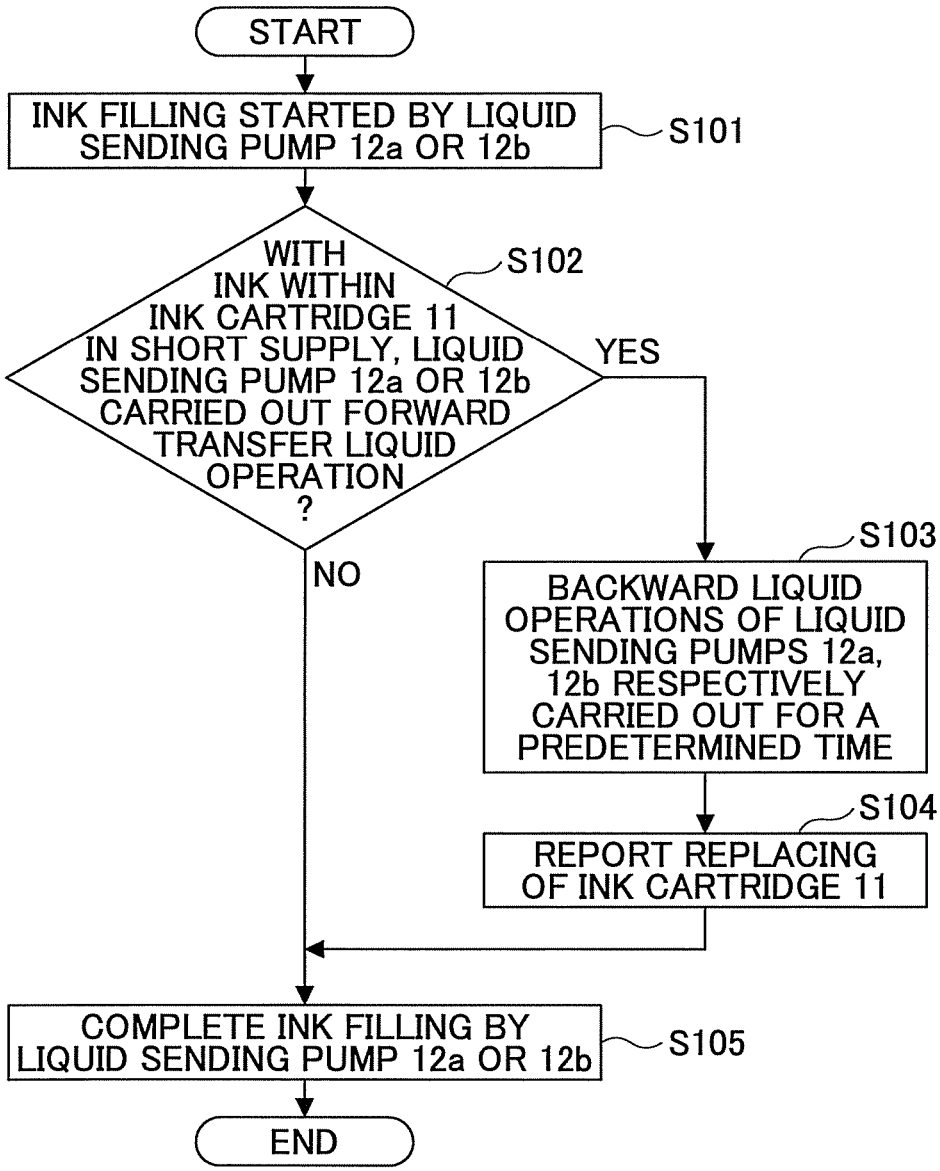
FIG. 8 is a flow chart illustrating a liquid sending control process at the time of replacing the ink cartridge in the inkjet recording device of the present invention.

FIG. 8 is a flowchart illustrating a liquid sending control at the time of replacing an ink cartridge in the inkjet recording device of the present invention. As shown, with ink within the ink cartridge 11 in short supply, at the time of an ink supplying operation for filling ink into with the head tank 14*a* or 14*b* in FIG. 6, when a forward transfer liquid operation of the liquid sending pump 12*a* or 12*b* is carried out (steps S101 and S102 (YES)), a backward transfer liquid operation of the liquid sending pump 12*a* or 12*b* is respectively carried out for a predetermined time corresponding to a predetermined amount of ink (step S103). Thereafter, the replacing of the ink cartridge 11 is reported to the user to complete ink filling to the head tank 14*a* or 14*b* (steps S104 and S105). Thus, a backward liquid sending of the liquid sending pump 12*a* and 12*b* can be respectively performed at the time of replacing the ink cartridge to prevent air bubbles from getting into the ink sending channel at the time of replacing the ink, making it possible to prevent and a failure such as a damage of a recording head, a nozzle clog, etc. The backward transfer liquid operation time of the liquid sending pump 12*a* or 12*b* is a time set up in accordance with a software count corresponding to an amount of ink used, an amount of ink remaining within a head tank due to a below described negative pressure lever provided at a head tank 14*a* or 14*b*, or a volume for each head tank.

Figure 9:
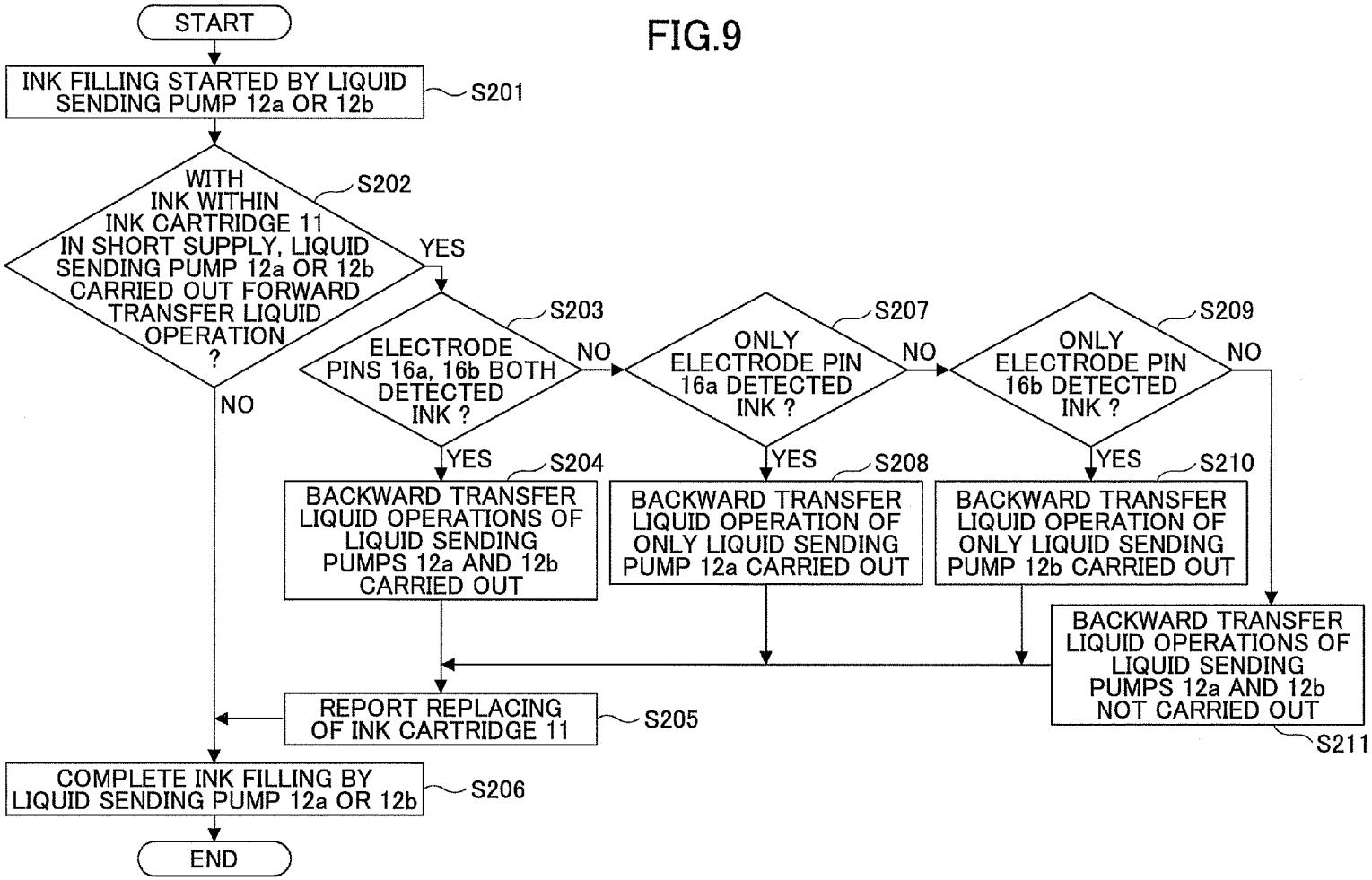
FIG. 9 is a flow chart illustrating another liquid sending control process at the time of replacing the ink cartridge in the inkjet recording device of the present invention.
Figure 10:
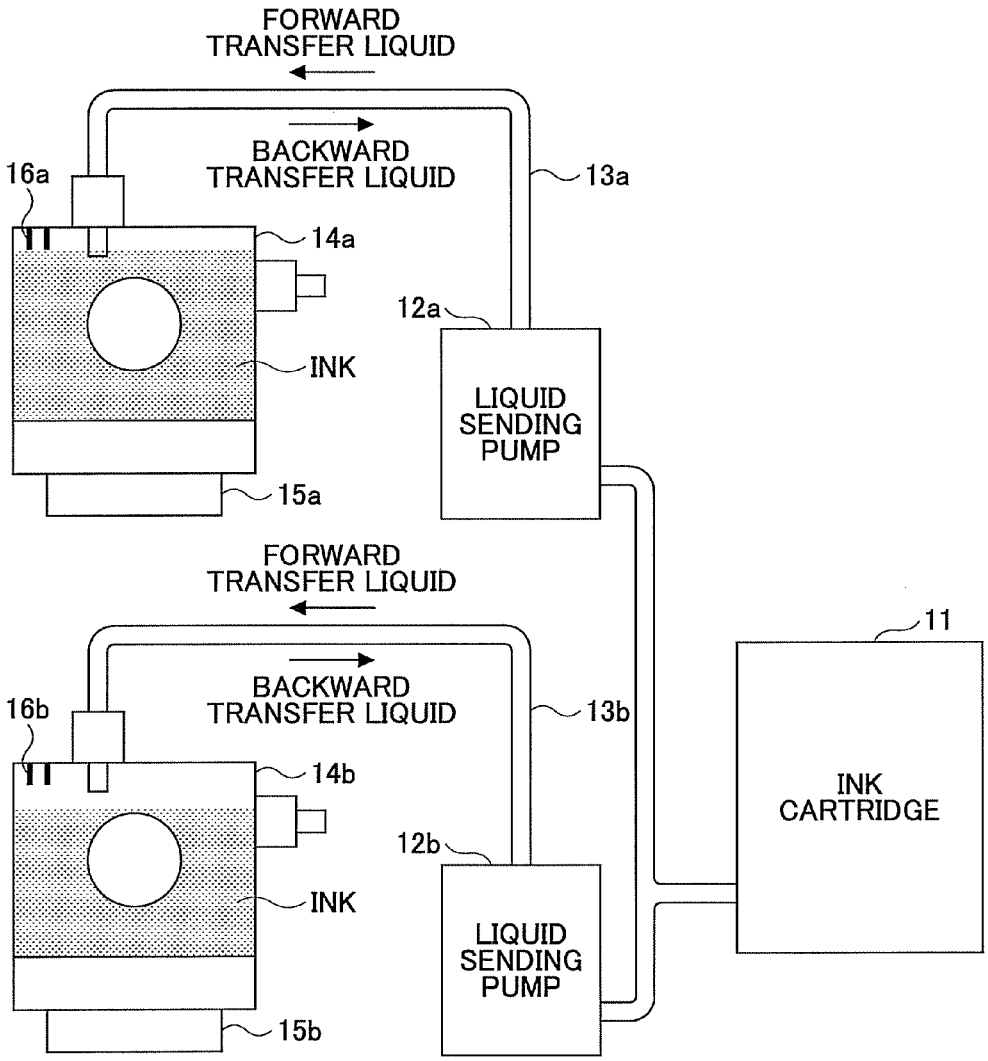
FIG. 10 is a schematic configuration diagram illustrating how an ink liquid level within each head tank is sensed.
Figure 11:
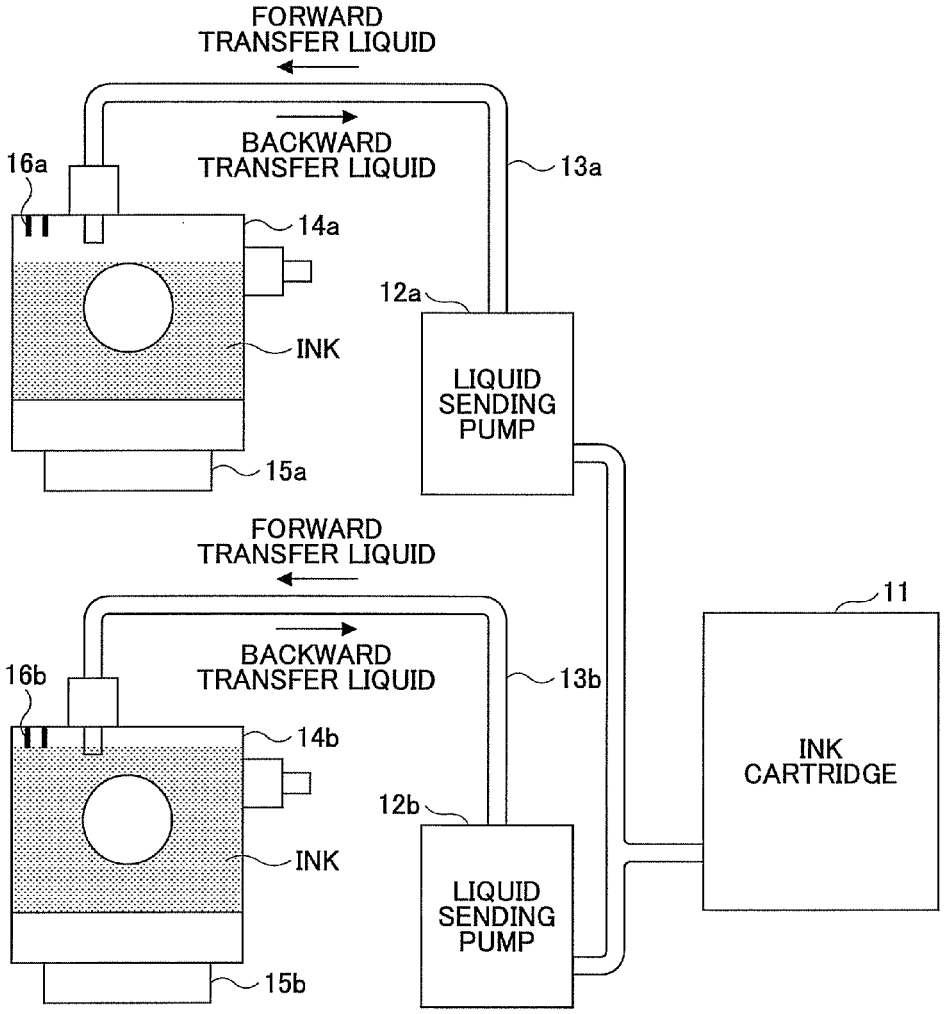
FIG. 11 is a schematic configuration diagram illustrating how the ink liquid level within each head tank is sensed.

FIG. 9 is a flowchart illustrating another liquid sending control process at the time of replacing the ink cartridge in the inkjet recording device of the present invention. As shown, with ink within the ink cartridge 11 in short supply, at the time of an ink supplying operation for filling ink into head tank 14*a* or 14*b* in FIG. 6, when a forward transfer liquid operation of the liquid sending pump 12*a* or 12*b* is carried out (steps S201 and S202 (YES)), in a case such that electrode pins 16*a* and 16*b* both detected ink, a backward transfer liquid operation of the liquid sending pump 12*a* or 12*b* is respectively carried out to report the replacing of the ink cartridge 11 to the user (steps S203 (YES), S204, and S205). Moreover, as shown in FIG. 10, when only the electrode pin 16*a* is detected, a backward transfer liquid operation of only the liquid sending pump 12*a* is carried out to report the replacing of the ink cartridge 11 to the user (step S203 (NO), step S207 (YES), steps S208 and S205). Moreover, as shown in FIG. 11, when only the electrode pin 16*b* is detected, a backward transfer liquid operation of only the liquid sending pump 12*b* is carried out to report the replacing of the ink cartridge 11 to the user (step S207 (NO), step S209 (YES), steps S210 and S205). Moreover, when neither of the electrode pins 16*a* and 16*b* are detected, replacing of the ink cartridge 11 is reported to the user without carrying out backward transfer liquid operations of the liquid sending pumps 12*a* and 12*b* (steps S209 (NO), S211 and S205). After the replacing of the ink cartridge 11 is reported to the user, ink filling to the head tank 14*a* or 14*b* is completed (step S206). Thus, air is prevented from getting into a liquid sending channel from the head tank by not performing backward liquid transfer from a pump not detected by an electrode pin. Moreover, a backward liquid transfer of the liquid sending pump 12 allows preventing an air bubble from getting into the ink sending channel at the time of replacing the ink cartridge, making it possible to prevent failures such as a damage of recording head, a nozzle clog, etc.

Figure 12:
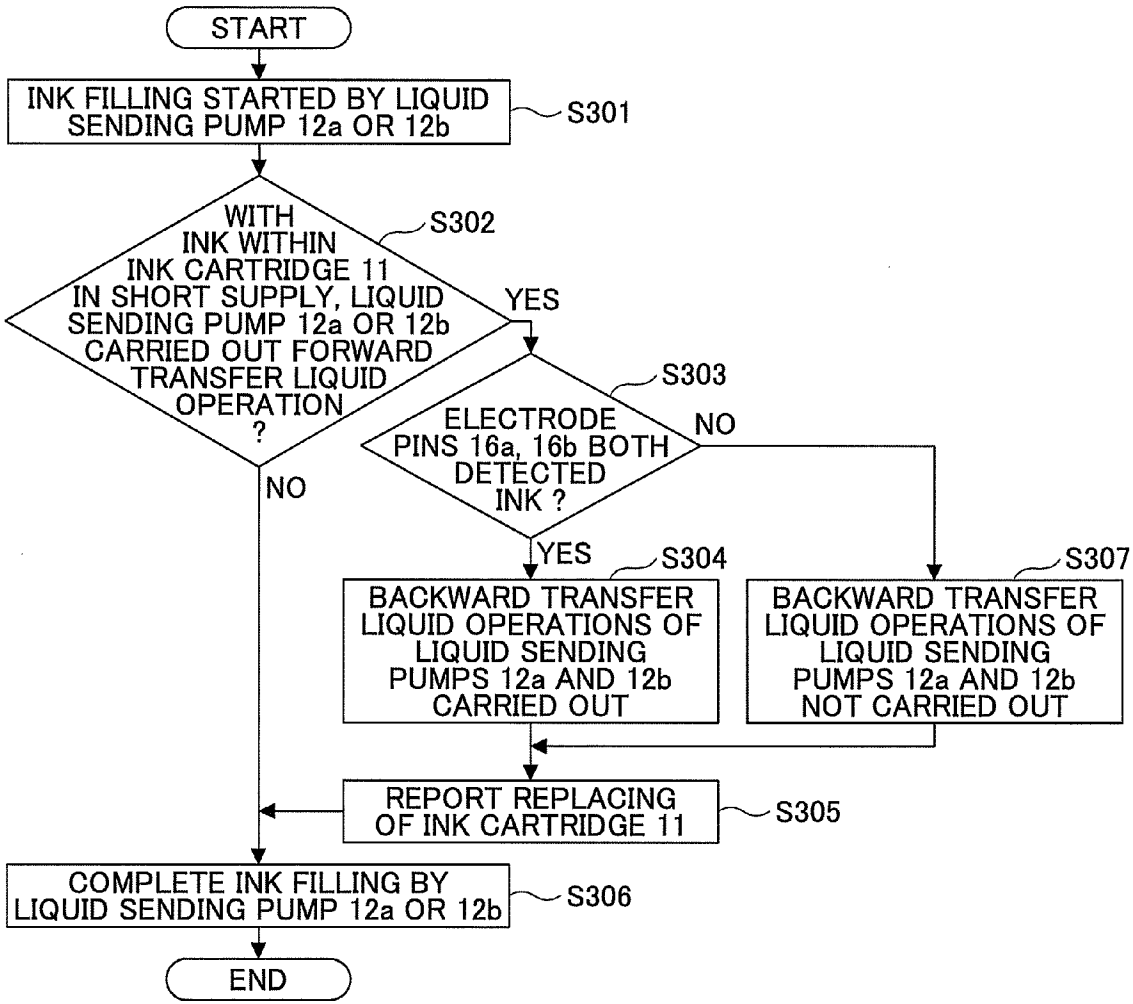
FIG. 12 is a flow chart illustrating another liquid sending control process at the time of replacing the ink cartridge in the inkjet recording device of the present invention.

FIG. 12 is a flowchart illustrating another liquid sending control process at the time of replacing the ink cartridge in the inkjet recording device of the present invention. As shown, with ink within the ink cartridge 11 in short supply, at the time of an ink supplying operation for filling ink into head tank 14*a* or 14*b* in FIG. 6, when a forward transfer liquid operation of the liquid sending pump 12*a* or 12*b* is carried out (steps S301 and S302 (YES)), if electrode pins 16*a* and 16*b* both detected ink, a backward transfer liquid operation of the liquid sending pump 12*a* or 12*b* is respectively carried out to report the replacing of the ink cartridge 11 to the user (steps S303 (YES), S304, and S305). Moreover, when either of electrode pins 16*a* and 16*b* does not detect, in other words, when only one of the electrode pins 16*a* and 16*b* detects, or neither of the electrode pins detect, the backward transfer liquid operation is not carried out (step S303 (NO) and step 307). Then, the replacing of the ink cartridge 11 is reported to the user (step S305). After the replacing of the ink cartridge 11 is reported to the user, ink filling to the head tank 14*a* or 14*b* is completed (step S306). Thus, air is prevented from getting into a liquid sending channel from the head tank by not performing backward liquid transfer from a pump not detected by an electrode pin. Moreover, a backward liquid transfer of the liquid sending pump 12 allows preventing an air bubble from getting into the ink sending channel at the time of replacing the ink cartridge, making it possible to prevent failures such as a damage of recording head and a nozzle clog.

Figure 13:
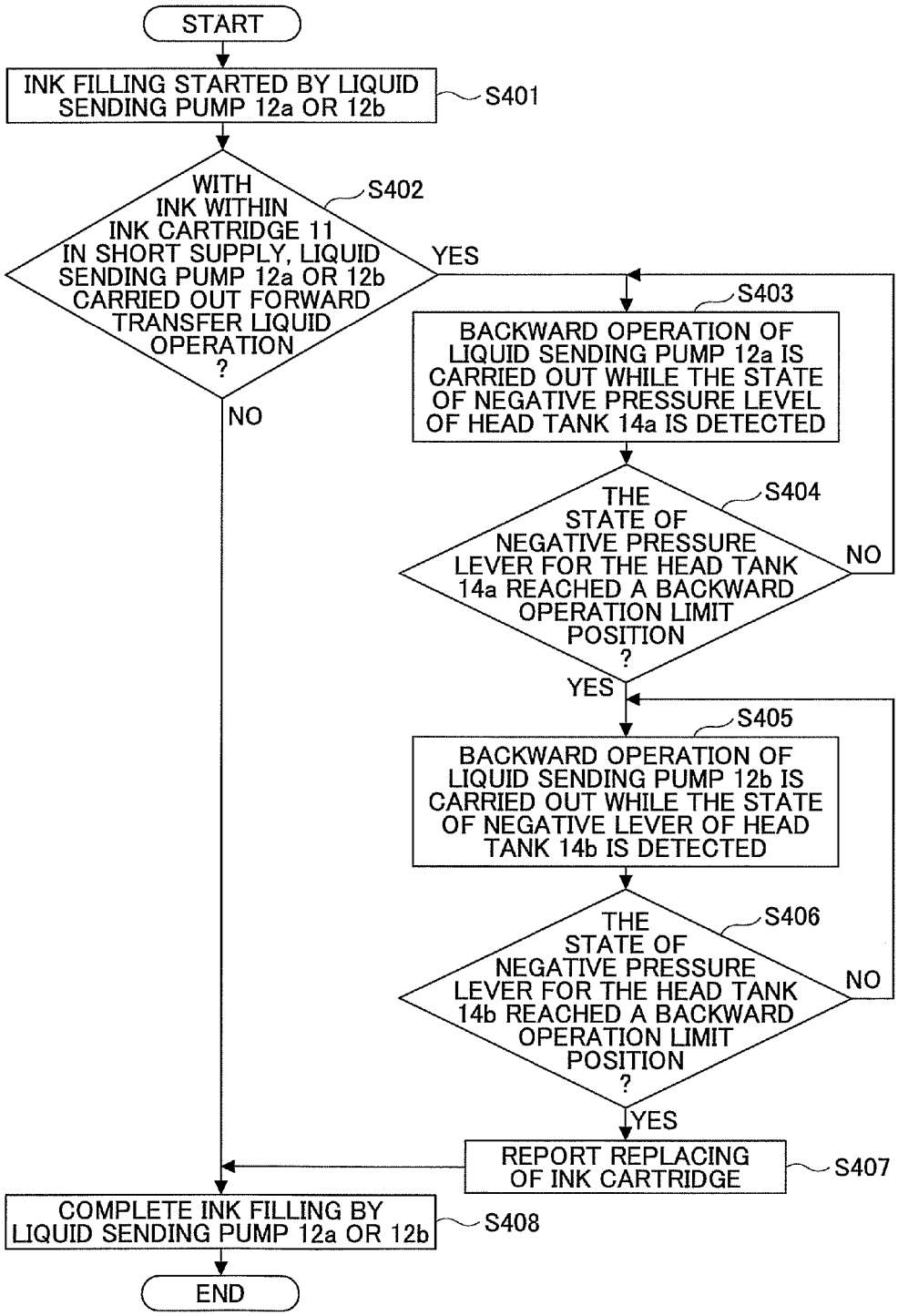
FIG. 13 is a flow chart illustrating another liquid sending control process at the time of replacing the ink cartridge in the inkjet recording device of the present invention.

FIG. 13 is a flowchart illustrating another liquid sending control process at the time of replacing the ink cartridge in the inkjet recording device of the present invention. As shown, with ink within the ink cartridge 11 in short supply, at the time of an ink supplying operation for filling ink into head tank 14*a* or 14*b* in FIG. 6, after a forward transfer liquid operation of the liquid sending pump 12*a* is carried out (steps S401 and S402 (YES)), a backward transfer liquid operation of the liquid sending pump 12*a* is carried out, while a negative pressure lever mounted to the head tank 14*a* is detected, as long as a state of the negative pressure lever mounted to the head tank 14*a* does not reach a backward operation limit position (steps S403 and S404 (NO)). Thereafter, when the state of the negative pressure lever mounted to the head tank 14*b* reaches a backward operation limit position (step S404 (YES)), a backward transfer liquid operation of the liquid sending pump 12*b* is carried out, while a negative pressure lever mounted to the head tank 14*b* is detected, as long as the state of the negative pressure lever mounted to the head tank 14*b* does not reach a backward operation limit position (steps S405, and S406 (NO)). Thereafter, when the state of the negative pressure lever mounted to the head tank 14*b* has reached a backward operation limit position (steps S406 (YES)), the replacing of the ink cartridge 11 is reported to the user, completing ink filling to the head tank 14*a* or 14*b* (steps S407 and S408). Thus, an air bubble is prevented from getting into the ink sending channel at the time of replacing the ink cartridge, making it possible to prevent failures such as a damage of the recording head, a nozzle clog, etc.

Now, a predetermined time for carrying out the backward liquid transfer operation of the liquid sending pump is briefly described. It is known that the predetermined time affects the volume between the ink cartridge and each liquid sending pump. It is known that a maximum air inflow amount value when running the liquid sending pump dry is 0.39 cc per liquid sending pump, for example. If the number of liquid sending pumps lying across one ink cartridge is 2, it is 0.78 cc, and if the number is 3, it is 1.17 cc. It is also known that the value increases almost in proportion to the number of liquid sending pumps. In other words, immediately after running the liquid sending pump dry, at least 0.39 cc per liquid sending pump is returned to the ink cartridge side, and an actual pump liquid sending amount value for each liquid sending pump is 0.3-0.6 cc/sec in all temperature environments, so that air generation may be prevented by sending liquid at a slowest liquid sending amount and carrying out a backward transfer liquid operation for 1.3 seconds for each liquid sending pump. 0.39 cc, which is a liquid sending amount for one liquid sending pump which lies across one ink cartridge, is approximately the same as a pump volume of a tube pump, so that a backward transfer liquid amount increases with an increase in the volume of the tube pump.

Moreover, it is known that the viscosity of ink within a liquid sending channel increases with a decrease in the temperature environment, leading to a tendency for a decreased speed in backward transfer liquid. For example, with the temperature environment as TA, at 20 degrees Centigrade≦TA, the liquid sending speed falls within a range of 0.49-0.6 cc/sec. Moreover, at 10 degrees Centigrade≦TA<20 degrees Centigrade, the liquid sending speed falls within a range of 0.39-0.6 cc/sec. Furthermore, at TA<10 degrees Centigrade, the liquid sending speed falls within a range of 0.3-0.6 cc/sec. Then, a time of backward transfer liquid operation performed to make it possible to prevent air generation at a minimum liquid sending speed at each temperature environment is 0.8 seconds for each liquid sending pump which lies across one ink cartridge at 20 degrees Centigrade≦TA, 1.0 seconds for 10 degrees Centigrade≦TA<20 degrees Centigrade, and 1.3 seconds for TA<10 degrees Centigrade. Below, liquid sending control at the time of replacing the ink tank in light of the temperature environment is described.

Figure 14:
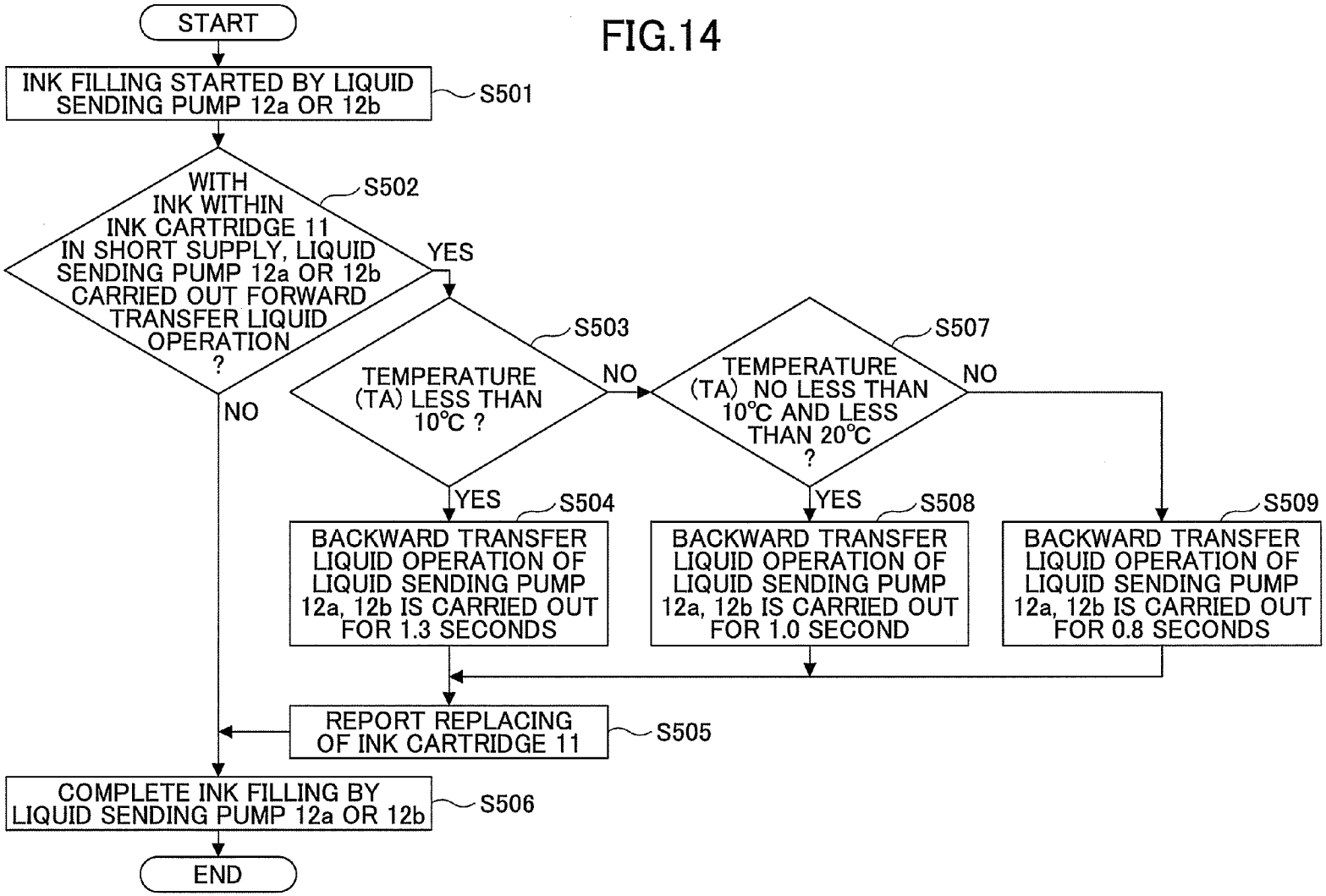
FIG. 14 is a flow chart illustrating another liquid sending control process at the time of replacing the ink cartridge in the inkjet recording device of the present invention.

FIG. 14 is a flowchart illustrating another liquid sending control process at the time of replacing the ink cartridge in the inkjet recording device of the present invention. As shown, with ink within the ink cartridge 11 in short supply, at the time of an ink supplying operation for filling ink into the head tank 14*a* or 14*b* in FIG. 6, after a forward transfer liquid operation of the liquid sending pump 12*a* is carried out (steps S501 and S502 (YES)), when the measured temperature environment TA is less than 10 degrees Centigrade (step S503 (YES)), a backward transfer liquid operation of the liquid sending pump 12*a* or 12*b* is respectively carried out for 1.3 seconds (step S504). Then, the replacing of the ink cartridge 11 is reported to the user (step S505). Moreover, when the measured temperature environment TA is not less than 10 degrees Centigrade and less than 20 degrees Centigrade (step S503 (NO), step S507 (YES)), the backward transfer liquid operation of the liquid sending pump 12*a* or 12*b* is respectively carried out for 1.0 sec (step S508). Then, the replacing of the ink cartridge 11 is reported to the user (step S505). Moreover, when the measured temperature environment TA is no less than 20 degrees Centigrade (step S507 (NO)), the backward transfer liquid operation of the liquid sending pump 12*a* or 12*b* is respectively carried out for 0.8 secs (step S509). Then, the replacing of the ink cartridge 11 is reported to the user (step S505). The ink filling to the head tank 14*a* or 14*b* is completed (step S506). Thus, an optimal liquid sending control at the time of replacing the ink cartridge in light of the temperature environment is performed, so that even when the temperature environment changes, it is made possible to prevent an air bubble from getting into the ink sending channel at the time of replacing the ink, making it possible to prevent failures such as a damage of the recording head, a nozzle clog, etc.

Thus, performing respective liquid sending control processes at the time of replacing the ink tank that are shown in FIGS. 8, 9, and 12 to 14 leads to a strong negative pressure being formed within a liquid sending channel while continuing to operate the liquid sending pump with a short supply of ink within the ink cartridge, for example, making it possible to prevent an air bubble from getting into a liquid sending channel when the ink cartridge is replaced, and making it possible to prevent failures such as a damage of a recording head, a nozzle clog, etc.

The present invention is not limited to the above embodiments, so that variations and replacements are possible within a scope of the claims.

The present application is based on the Japanese Priority Application No. 2009-204220 filed on Sep. 4, 2009, the entire contents of which is hereby incorporated by reference.

The invention claimed is:

1. An inkjet recording apparatus, comprising:

a droplet ejecting head which has multiple nozzles for ejecting ink, multiple head tanks which generate a negative pressure at the droplet ejecting head and temporarily store a predetermined amount of ink, an ink cartridge which stores the ink, multiple liquid sending pumps which perform a forward transfer liquid process which sends the ink from the ink cartridge to the multiple head tanks, or a backward transfer liquid process which sends the ink from the multiple head tanks to the ink cartridge, an ink supply channel being branched from the ink cartridge to multiple head tanks to supply ink from the ink cartridge to multiple head tanks by the corresponding one of multiple liquid sending pumps, and an ink liquid level sensing unit which senses a height of an ink liquid level within each of the head tanks, wherein, when the height of the ink liquid level within the head tanks that is sensed by the ink liquid level sensing unit provided at any one of the multiple head tanks across the multiple liquid sending pumps being branched is less than a predetermined height, the backward transfer liquid process of each of the liquid sending pumps is not performed, and wherein at least one of the multiple liquid sending pumps performs the forward transfer liquid process when there is a short supply of ink in the ink cartridge without being able to send the ink from the ink cartridge to one of the head tanks, and then each of the multiple liquid sending pumps performs the backward transfer liquid process for a predetermined ink amount.

2. The inkjet recording apparatus as claimed in claim 1, wherein the predetermined ink amount in the backward transfer liquid process is set according to a storage volume of one of the head tanks.

3. The inkjet recording apparatus as claimed is claim 1, wherein the predetermined ink amount in the backward transfer liquid process is set according to an amount of ink used that is measured by a soft counter.

4. The inkjet recording apparatus as claimed in claim 1, wherein the predetermined ink amount in the backward transfer liquid process is set according to an environmental temperature.

5. The inkjet recording apparatus as claimed in claim 1, wherein, when the height of the ink liquid level within the head tanks that is sensed by the ink liquid level sensing unit provided at any one of the multiple head tanks across the multiple liquid sending pumps being branched is less than a predetermined height, the backward transfer liquid process of each of the liquid sending pumps only to one of the head tanks is not performed.

6. The inkjet recording apparatus as claimed in claim 1, wherein one of the liquid sending pumps is a tube pump.

7. The inkjet recording apparatus as claimed in claim 1, wherein, when the height of the ink liquid level within the head tanks, that is sensed by the ink liquid level sensing unit provided at any one of the multiple head tanks across the multiple liquid sending pumps being branched from the ink cartridge, is less than a predetermined height, the backward transfer liquid process of each of the liquid sending pumps is not performed.

8. An inkjet recording apparatus, comprising:

a droplet ejecting head which has multiple nozzles for ejecting ink, multiple head tanks which generate a negative pressure at the droplet ejecting head and temporarily store a predetermined amount of ink, an ink cartridge which stores the ink, multiple liquid sending pumps which perform a forward transfer liquid process which sends the ink from the ink cartridge to the multiple head tanks, or a backward transfer liquid process which sends the ink from the multiple head tanks to the ink cartridge, and an ink supply channel being branched from the ink cartridge to multiple head tanks to supply ink from the ink cartridge to multiple head tanks by the corresponding, one of multiple liquid sending pumps, wherein at least one of the multiple liquid sending pumps performs the forward transfer liquid process when there is a short supply of ink in the ink cartridge without being able to send the ink from the ink cartridge to one of the head tanks, and then each of the multiple liquid sending pumps performs the backward transfer liquid process for a predetermined ink amount, and wherein the predetermined ink amount in the backward transfer liquid process corresponds to an ink amount when a position of a negative pressure lever for sensing a state of a negative pressure within one of the head tanks that is displaced in response to an amount of ink stored in one of the head tanks reaches a limit position such that the negative pressure within one of the head tanks is not lost.

9. The inkjet recording apparatus as claimed in claim 8, wherein the predetermined ink amount in the backward transfer liquid process is set according to a storage volume of one of the head tanks.

10. The inkjet recording apparatus as claimed in claim 8, wherein the predetermined ink amount in the backward transfer liquid process is set according to an amount of ink used that measured by a soft counter.

11. The inkjet recording apparatus as claimed in claim 8, wherein the predetermined ink amount in the backward transfer liquid process is set according to an environmental temperature.

12. The inkjet recording apparatus as claimed in claim 8, wherein, when the height of the ink liquid level within the head tanks that is sensed by the ink liquid level sensing unit provided at any one of the multiple head tanks across the multiple liquid sending pumps being branched is less than a predetermined height, the backward transfer liquid process of each of the liquid sending pumps only to one of the head tanks is not performed.

13. An inkjet recording apparatus, comprising:

a droplet ejecting head which has multiple nozzles for ejecting ink, multiple head tanks which generate a negative pressure at the droplet ejecting head and temporarily store a predetermined amount of ink, an ink cartridge which stores the ink, multiple liquid sending pumps which perform a forward transfer liquid process which sends the ink from the ink cartridge to the multiple head tanks, or a backward transfer liquid process which sends the ink from the multiple head tanks to the ink cartridge, and an ink supply channel being branched from the ink cartridge to multiple head tanks to supply ink from the ink cartridge to multiple head tanks by the corresponding one of multiple liquid sending pumps, wherein at least one of the multiple liquid sending pumps performs the forward transfer liquid process when there is a short supply of ink in the ink cartridge without being able to end the ink from the ink cartridge to one of the head tanks, and then each of the multiple liquid sending pumps performs the backward transfer liquid process for a predetermined ink amount, and wherein one of the liquid sending pumps is a tube pump in which a direction of sending ink is controlled by conducting forward transfer of ink in which the ink is sent from an ink cartridge to a head tank and by conducting backward transfer of ink in which the ink is sent from the head tank to the ink cartridge by locally squeezing, with a rotor, a tube which crawls inside a pump and rotating the rotor forward or backward.

14. The inkjet recording apparatus as claimed in claim 13, wherein, when the height of the ink liquid level within the head tanks, that is sensed by the ink liquid level sensing unit provided at any one of the multiple head tanks across the multiple liquid sending pumps being branched from the ink cartridge, is less than a predetermined height, the backward transfer liquid process of each of the liquid sending pumps is not performed.

15. The inkjet recording apparatus as claimed in claim 13, wherein the predetermined ink amount in the backward transfer liquid process is set according to a storage volume of one of the head tanks.

16. The inkjet recording apparatus as claimed in claim 13, wherein the predetermined ink amount in the backward transfer liquid process is set according to an amount of ink used that is measured by a soft counter.

17. The inkjet recording apparatus as claimed in claim 13, wherein the predetermined ink amount in the backward transfer liquid process is set according to an environmental temperature.

18. The inkjet recording apparatus as claimed in claim 13, wherein, when the height of the ink liquid level within the head tanks that is sensed by the ink liquid level sensing unit provided at any one of the multiple head tanks across the multiple liquid sending pumps being branched is less than a predetermined height, the backward transfer liquid process of each of the liquid sending pumps only to one of the head tanks is not performed.

* * * * *